US010794062B2

(12) United States Patent
Michels

(10) Patent No.: US 10,794,062 B2
(45) Date of Patent: Oct. 6, 2020

(54) MODULAR STAIR SYSTEM

(71) Applicant: EMEH, INC., Lebanon, NJ (US)

(72) Inventor: Jeremy Michels, Melissa, TX (US)

(73) Assignee: EMEH, INC., Lebanon, NJ (US)

( * ) Notice: Subject to any disclaimer, the term of this patent is extended or adjusted under 35 U.S.C. 154(b) by 0 days.

(21) Appl. No.: 16/510,281

(22) Filed: Jul. 12, 2019

(65) Prior Publication Data

US 2019/0338529 A1 Nov. 7, 2019

Related U.S. Application Data

(62) Division of application No. 15/844,029, filed on Dec. 15, 2017, now Pat. No. 10,370,856.

(51) Int. Cl.
*E04F 11/02* (2006.01)
*E04B 1/24* (2006.01)
(Continued)

(52) U.S. Cl.
CPC ..... *E04F 11/025* (2013.01); *E04B 1/2403* (2013.01); *E04F 11/035* (2013.01);
(Continued)

(58) Field of Classification Search
CPC ..... E04F 11/02; E04F 11/025; E04F 11/035; E04F 11/038; E04F 11/09; E04F 11/116;
(Continued)

(56) References Cited

U.S. PATENT DOCUMENTS 3,052,332 A * 9/1962 Mulitz ..... E04F 11/02 52/185
3,175,654 A * 3/1965 Calvert ..... E04F 11/02 52/127.2

(Continued)

FOREIGN PATENT DOCUMENTS

CN 203008256 U ‡ 6/2013
CN 203547162 U ‡ 4/2014

(Continued)

OTHER PUBLICATIONS

Machine translation of KR0762420 B1, KIPRIS, http://engpat.kipris.or.kr/pmt/patent/patentRTT.jsp Jun. 4, 2018 (Year: 2018).*

(Continued)

*Primary Examiner* — Ryan D Kwiecinski

(57) ABSTRACT

A method for building modular stair system comprises assembling a plurality of modular stair units, each of the plurality of modular stair units associated with a single story of a construction, each of the plurality of modular stair units further comprising a self-supporting structure supported by a plurality of corner columns. A first modular stair unit is located on a foundation of a structure. The first modular stair unit is secured to the foundation of the structure. A second modular stair unit is stacked on top of the first modular stair unit, wherein a first plurality of corner support columns engage of the first modular stair unit engage a second plurality of corner support columns of the second modular stair unit. The second modular stair unit is leveled using a connection sleeve that slides within the first plurality of corner support columns and the second plurality of corner support columns. The second modular stair unit is connected to the first modular stair unit to maintain the leveled second modular stair unit using the connection sleeve.

20 Claims, 10 Drawing Sheets

(51) Int. Cl.
*E04F 11/025* (2006.01)
*E04F 11/035* (2006.01)
*E04F 11/116* (2006.01)

(52) U.S. Cl.
CPC . *E04B 2001/246* (2013.01); *E04B 2001/2415* (2013.01); *E04F 11/116* (2013.01); *E04F 2011/0209* (2013.01)

(58) Field of Classification Search
CPC ..... E04F 2011/0209; E04B 1/185; E04B 1/2403; E04B 1/2604; E04B 1/2608; E04B 2001/2415; E04B 2001/246; E04B 2001/2451; E04B 2001/2463; E04B 2001/2644; E04B 2001/2692; E04G 13/062
USPC ..... 52/182, 185, 191
See application file for complete search history.

(56) References Cited

U.S. PATENT DOCUMENTS 3,228,154 A * 1/1966 Mulitz ..... E04F 11/02 52/185
3,670,848 A * 6/1972 Raiguel, Jr. ..... E04F 11/02 182/115
3,707,814 A * 1/1973 Seegers ..... E04F 11/02 52/185
3,859,771 A * 1/1975 Simmons ..... E04F 11/02 52/741.2
3,927,518 A * 12/1975 Simmons ..... E04G 27/00 52/183
4,858,726 A * 8/1989 Preston ..... E04G 1/34 182/152
5,491,939 A * 2/1996 Wang ..... E04F 11/02 52/185
5,660,005 A ‡ 8/1997 Tacoma ..... E04B 1/24 52/222
6,484,450 B1 * 11/2002 Suprina ..... A47C 1/12 248/161
7,048,462 B2 * 5/2006 Lanphier ..... E04F 11/1812 256/65.14
7,258,199 B2 * 8/2007 Hayes, Sr. ..... E04G 27/00 182/178.1
7,971,408 B2 ‡ 7/2011 Hayes, Sr. ..... E04G 27/00 52/143
9,057,190 B1 * 6/2015 Winter ..... E04F 15/02044
9,085,904 B2 * 7/2015 Hopper ..... E04F 11/02
2004/0050010 A1 * 3/2004 Fortier ..... E04H 3/28 52/650.3
2007/0261356 A1 * 11/2007 Vaughn ..... E02D 27/34 52/655.1
2008/0017448 A1 * 1/2008 Hayes, Sr. ..... E04G 27/00 182/178.1
2011/0271613 A1 * 11/2011 Hopper ..... F03D 13/20 52/185
2012/0240482 A1 * 9/2012 Pitt ..... E04B 1/3483 52/122.1
2015/0152630 A1 * 6/2015 Winter ..... E04F 15/02044 52/633
2016/0208495 A1 * 7/2016 Haaslahti ..... E04F 11/02
2017/0233996 A1 * 8/2017 Abernathy ..... E04B 1/2403 52/698
2017/0314254 A1 * 11/2017 Houghton ..... E04B 1/1912
2018/0094418 A1 * 4/2018 Winter ..... E04B 1/1903
2018/0148919 A1 * 5/2018 Rebollar Buldain ..... E04B 1/2403

FOREIGN PATENT DOCUMENTS

DE 2701187 A1 * 7/1978 ..... E04B 1/945
GB 1014144 A * 12/1965 ..... E04F 11/02
GB 1061783 A * 3/1967 ..... E04B 1/185
JP 03072140 A * 3/1991
JP 05202593 A * 8/1993
JP 06108604 A * 4/1994
KR 0762420 B1 * 10/2018
KR 0762420 B1 ‡ 10/2018
WO WO-2013000985 A2 * 1/2013 ..... E04H 5/02

OTHER PUBLICATIONS

PCT: International Search Report and Written Opinion of PCT/US2018/064406 (related application); dated Feb. 15, 2019; 11 pages.‡
PCT: International Preliminary Report on Patentability and Written Opinion of the International Searching Authority of PCT/US2018/064406 (related application); Xiaofan Tang; dated Jun. 25, 2020; 9 pages.

* cited by examiner
‡ imported from a related application

MODULAR STAIR SYSTEM

CROSS REFERENCE TO RELATED APPLICATIONS

This application is a divisional of U.S. patent application Ser. No. 15/844,029, filed Dec. 15, 2017, entitled MODULAR STAIR SYSTEM, the specification of which is incorporated by reference herein in its entirety.

TECHNICAL FIELD

This application relates to a system and method for building stairs, and more particularly, to a system and method for building a modular stair system.

BACKGROUND

In both residential and commercial construction, the building of stairs enabling access from one level to another is a time-consuming process. Normally, the levels of a building structure are constructed and at some later point in time the stairs between levels are built as part of the previously built structure. In normal circumstances, this may take several days in order to build the stairs from the ground floor to the upper floors in a multilevel structure. Additionally, when stairs from one level to another level have not been completed, alternative methods for moving between the levels, such as ladders, must be used to enable workers and inspectors to move between the different levels. The use of ladders and other temporary means for moving between levels are less safe than a normal stair structure. Thus, there is a need for the ability to more quickly construct stair structures within a residential or commercial construction that improves safety at the construction work site and minimizes construction time to improved efficiencies.

SUMMARY

The present invention, as disclosed and described herein, in one aspect thereof, comprises a method for building modular stair system comprises assembling a plurality of modular stair units, each of the plurality of modular stair units associated with a single story of a construction, each of the plurality of modular stair units further comprising a self-supporting structure supported by a plurality of corner columns. A first modular stair unit is located on a foundation of a structure. The first modular stair unit is secured to the foundation of the structure. A second modular stair unit is stacked on top of the first modular stair unit, wherein a first plurality of corner support columns engage of the first modular stair unit engage a second plurality of corner support columns of the second modular stair unit. The second modular stair unit is leveled using a connection sleeve that slides within the first plurality of corner support columns and the second plurality of corner support columns. The second modular stair unit is connected to the first modular stair unit to maintain the leveled second modular stair unit using the connection sleeve.

BRIEF DESCRIPTION OF THE DRAWINGS

For a more complete understanding, reference is now made to the following description taken in conjunction with the accompanying Drawings in which.

DETAILED DESCRIPTION

Figure 1:
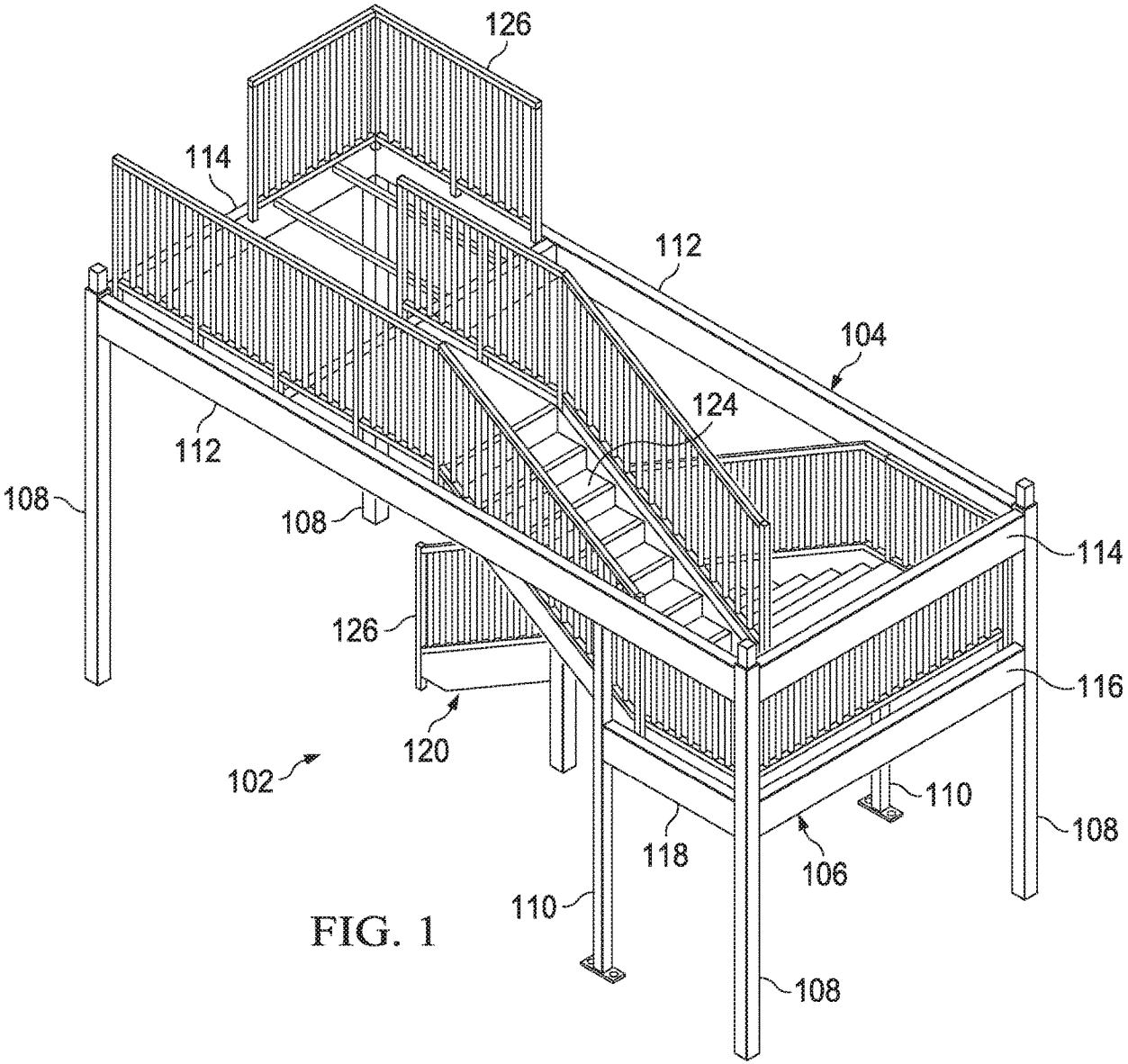
FIG. 1 illustrates a perspective view of the modular stair unit.

Referring now to the drawings, wherein like reference numbers are used herein to designate like elements throughout, the various views and embodiments of a modular stair system are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Figure 2:
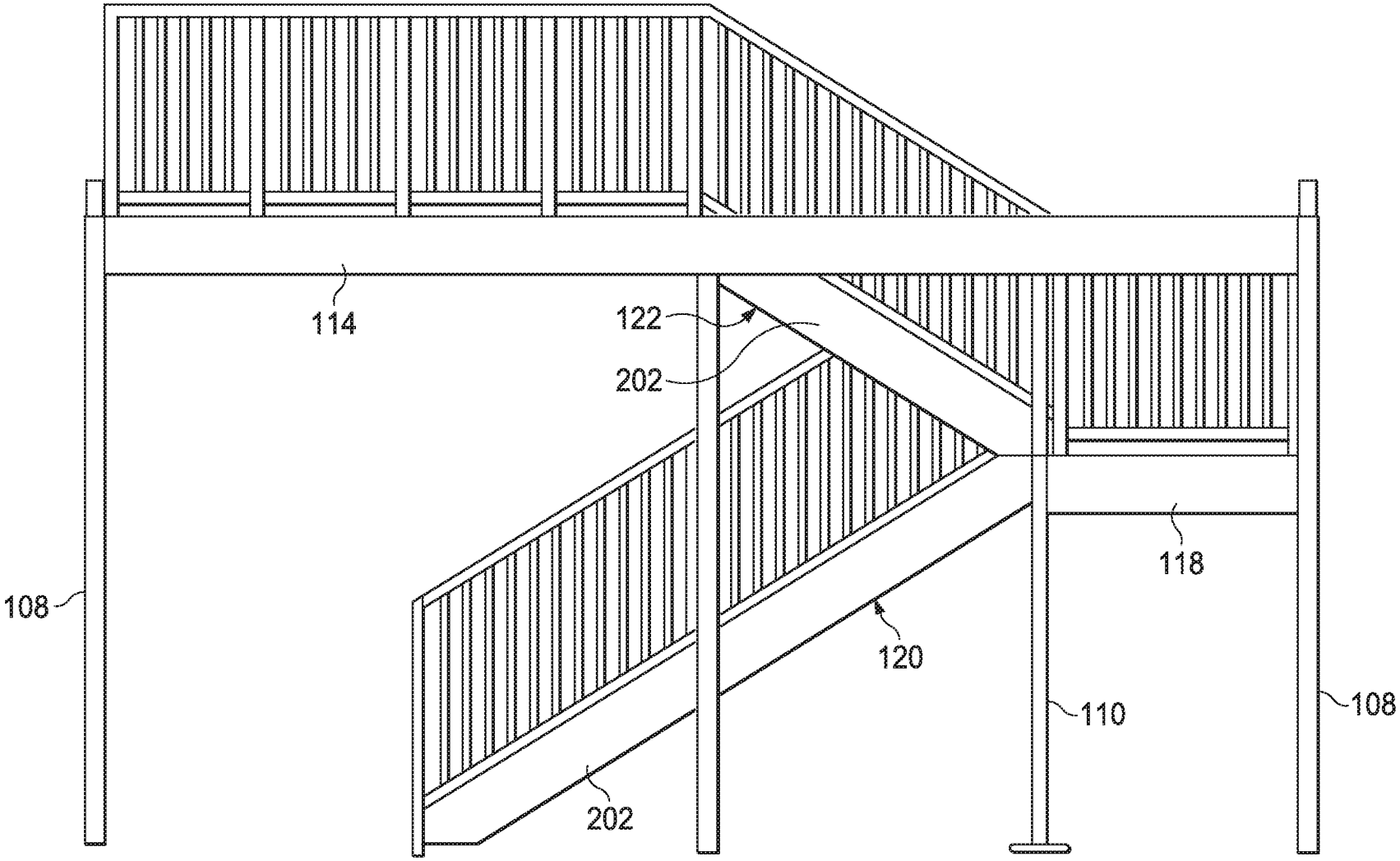
FIG. 2 illustrates a side view of the modular stair unit.
Figure 3:
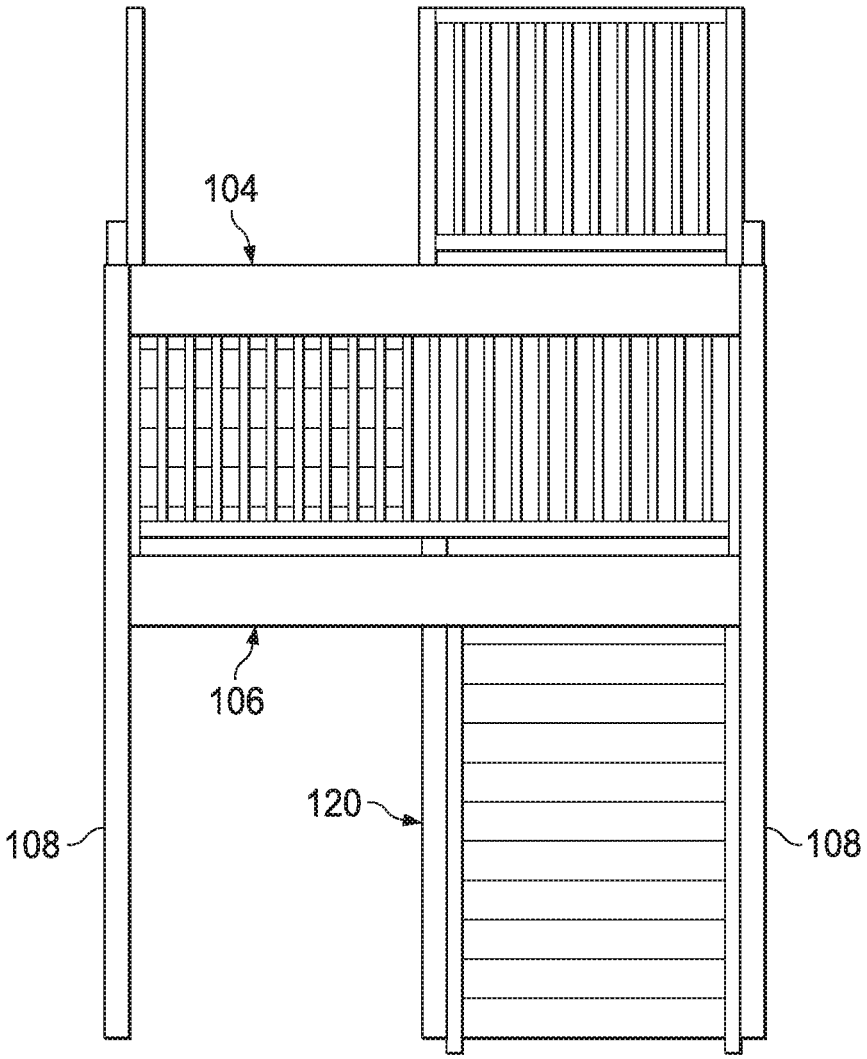
FIG. 3 illustrates an end view of the modular stair unit.

A modular stair unit 102 is illustrated in FIGS. 1-3. FIG. 1 illustrates a perspective view of the modular stair unit 102. FIG. 2 illustrates a side view of the modular stair unit, and FIG. 3 illustrates an end view of the modular stair unit. The modular stair unit 102 includes a top landing 104 and mid-landing 106. The top landing 104 is raised into the air using a group of four corner columns 108 and two central columns 110. The corner columns 108 are removably connected to each corner of the top landing 104 using bolts or some other type of removable connecting means. The corner columns 108 in one embodiment comprise square tubular steel components of variable size. The size of the corner columns 108 may be adjusted based upon the number of stair modules 102 that are to be stacked upon one another. Larger rectangular sized columns 108 would be utilized for stacking more modules 102 on top of one another. The center columns 110 are mounted at some location along the long edge of the top landing 104 and are removably connected to the top landing 104 using bolts or some other type of removable connection.

The top landing 104 consist of a number of members connected in a rectangular shape having a pair of long sides 112 and a pair of short sides 114. Long members 112 and short members 114 are bolted together at their ends as will be more fully described herein below, to provide for the connection of different sizes of corner columns 108. In one embodiment, the long members 112 and the short members 114 comprise 12 inch beams.

The mid-landing 106 is adjustably connected to a point on a pair of the corner columns 108 and a pair of the center columns 110. Using bolts or some other type of removable connecting mechanism the mid-landing 106 may be moved to a plurality of locations between the top end of the pair of corner columns 108 and the pair of center columns 110 and the bottom of these columns. The mid-landing 106 also comprises a pair of long members 116 and a pair of short members 118 that are interconnected at their ends to form a rectangle that bolts to the corner columns 108 and center columns 110 as will be more fully described herein below. The long members 116 and short members 118 comprise in one embodiment 12 inch beams.

A lower stair runner 120 provides steps from the ground level or floor level to the mid-landing 106. The upper stair runner 122 provides steps from the mid-landing 106 to the top landing 104. The lower stair runner 120 is removably connected to the mid-landing 106 using bolts or some other type of removably connectable mechanism. The upper stair runner 122 is removably connected to the mid-landing 106 and the top landing 104 using bolts or some other type of removably connectable mechanism. Each of the lower stair runner 120 and the upper stair runner 122 consist of a pair of stringers 202 located on each side of the runners with a plurality of tread pans 124 located there between. The tread pans 124 consist of a metal well that can be filled with concrete in order to provide a step tread. The tread pans 124 may be used as stairs before the concrete is poured therein further speeding use of the stair modules 102 when assembled.

A number of railings 126 surround the outer edges of the upper landing 104 mid-landing 106 and each of the upper stair runner 122 and lower stair runner 120. The railings are removably connected via bolts or some other type of removable connection mechanism and provide for safety of individuals using the modular stair system 102.

Figure 4:
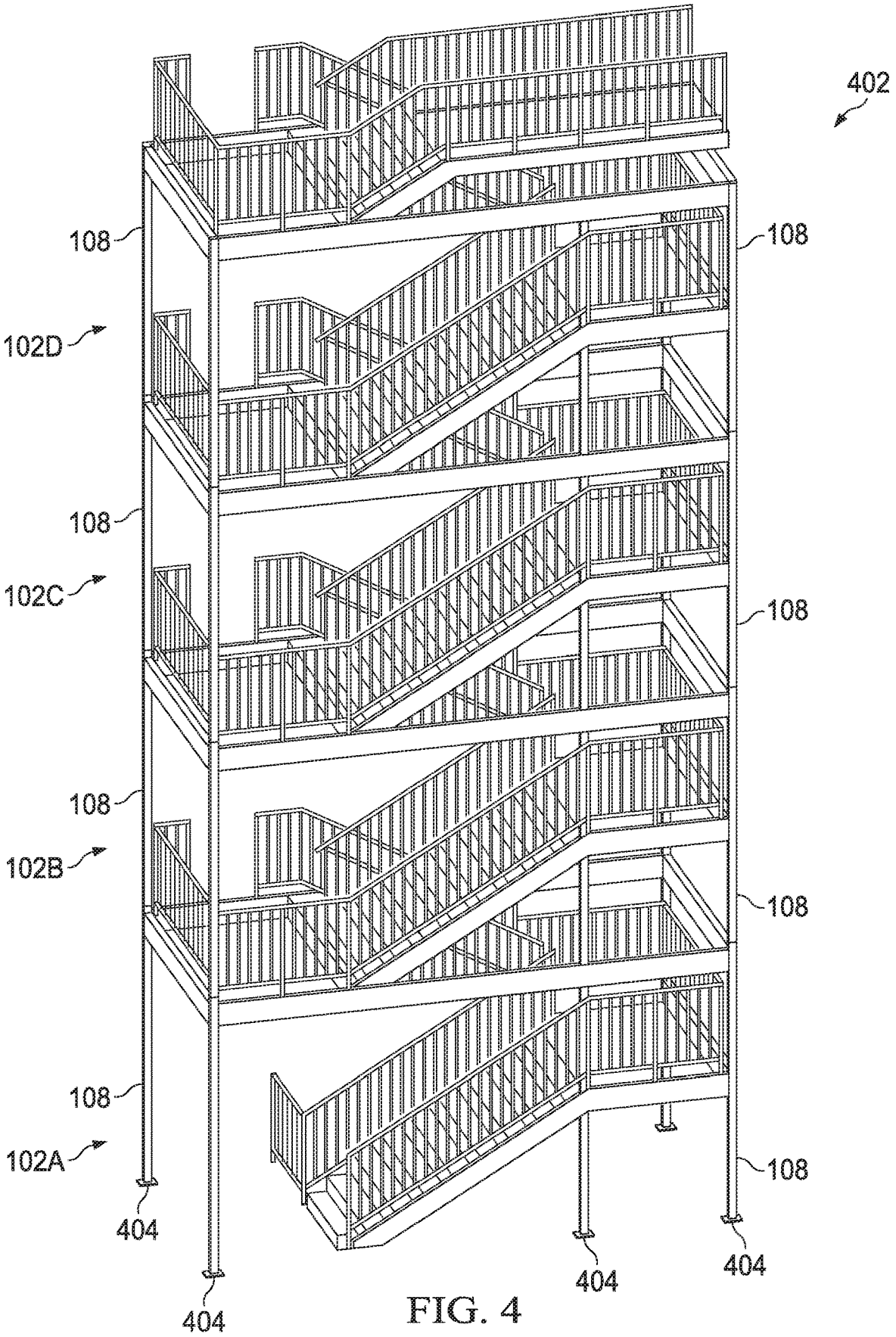
FIG. 4 illustrates an assembled stairwell structure using modular stair units.

Referring now to FIG. 4, there is illustrated an assembled stairwell structure 402 utilizing four different modular stair units 102. The bottom modular stair unit 102A is secured to the foundation using a number of foundation brackets 404. The foundation brackets 404 are secured to the foundation using some type of foundation bolts, foundation screws or other type of foundation securing mechanism. Once the bottom modular stair unit 102A has been secured to the foundation, a next modular stair unit 102B is lowered into place on top of the bottom modular stair unit 102A. The modular stair unit 102B and the modular stair unit 102A are interconnected at their corner columns 108. The bottom of the corner columns 108 of the upper modular stair unit 102B are connected to the top of the corner columns of the bottom modular stair unit 102A using a connection sleeve 1002 (FIG. 10), as will be more fully described hereinbelow. The connection sleeve 1002 slides within the rectangular tubular member comprising the corner columns 108 and are then bolted thereto allowing the modular stair units 102A and 102B to be securely fastened to each other at each of the corner columns.

Figure 5:
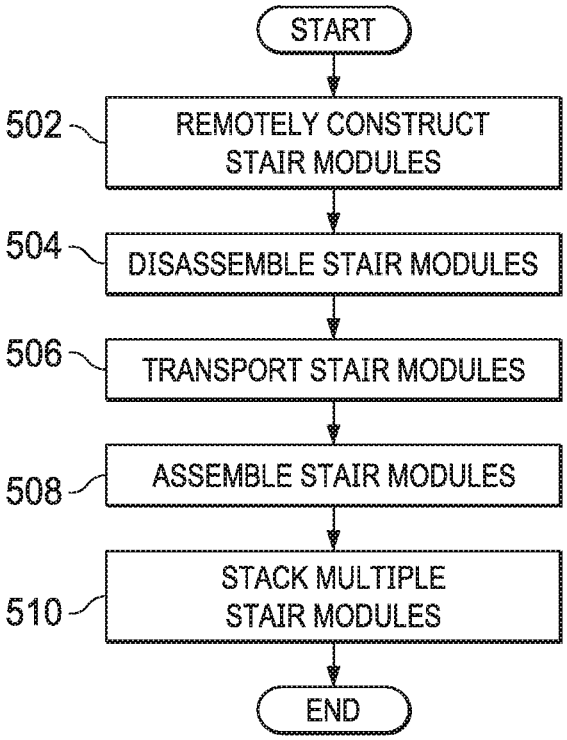
FIG. 5 illustrates a flow diagram describing the process for building a modular stair unit.

Modular stair unit 102C connects to modular stair unit 102B in a similar fashion. The base of the corner columns 108 of modular stair unit 102C are connected to the top of the corner columns 108 of modular stair unit 102B using the connection sleeve 1002. Likewise the top modular stair unit 102D has the base of its corner columns 108 connect to the top of the corner columns 108 of modular stair unit 102C. Each of the modular stair units 102 are lowered into place on the foundation or on to the previously placed modular stair unit using a crane. Referring now to FIG. 5, there is illustrated a flow diagram describing the process for assembling stairwell using the above described modular stair units 102. Initially, the individual modular stair units 102 are constructed at a remote location. The number of modular stair units 102 necessary for a particular construction site are constructed based upon the number of stairwells needed at a construction site and the number of levels within the structure being built. Once the required number of modular stair units 120 have been constructed, the modular stair units are disassembled at step 504 into their component parts. As discussed previously, the component parts comprise the top landing 104, mid-landing 106, upper stair runner 120, lower stair runner 122, corner columns 108, center columns 110 and railings 126. Each of these individual components are separated from each other by disconnecting the associated nut and bolt connections or other type of removable connection assembly utilized.

Figure 6:
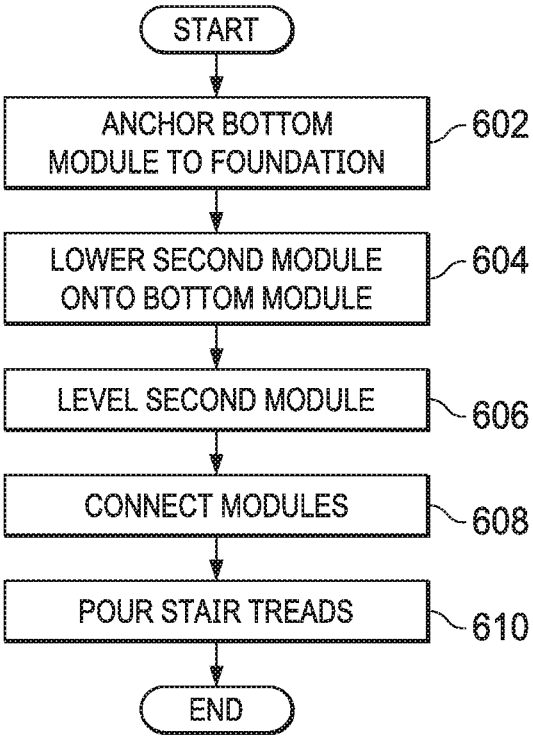
FIG. 6 illustrates a flow diagram describing the process for assembling a stairwell.

Next, each of the individual component parts are loaded onto trailers and transported at step 506 to the construction site. Once the disassembled modular stair units 102 arrive at the construction site, the modular stair units are reassembled at step 508 utilizing the same previously discussed nut and bolt type or other connection assembly utilized in the construction. Once the modular stair units 102 have been reassembled, the modular stair units may be stacked to construct a stairwell in a manner that will now be more fully discussed with respect to FIG. 6. Within the stacking process, the bottom modular stair unit 102 is first anchored at step 602 to the foundation of the structure. Next, the second modular stair unit 102 for the second floor is lowered on to the previously placed modular stair unit. The bottom of the corner columns 108 of the second modular stair unit 102 are aligned with the top of the corner columns of the lower modular stair unit and the second modular stair unit is leveled at step 606. The leveling mechanism will be more fully described hereinbelow. Once the second modular stair unit 102 is leveled, the second modular stair unit is connected at step 608 to the lower modular stair unit using the connection sleeves 1002. This process may then be repeated for each additional level by stacking the upper modular stair unit 102 onto the lower modular stair unit and connecting the corner columns 108 in a similar fashion. Once each of the modular stair units 102 have been placed and connected, the concrete stair treads may be poured at step 610 for each of the treads within the stairwell and the associated tread pans.

In this manner, a multi-level stairwell can be quickly built in just a few hours. Normally, the construction of a set of stairs within a multi-level structure will take several days in order to completely build the stair structure. By using the described modular stair units, the process may be completed in hours rather than days. The process additionally provides a number of safety factors to the construction site. Normally, a floor level must be created before the associated stair structure can be built as the stair structure is connected to and supported by the surrounding floor level. The modular stair unit system is self-supporting and can be erected even before any of the surrounding construction has been started. The associated floor level may then be built around the already established stairwell. The ability to erect the stair structure prior to or substantially concurrent with the building of the associated floor levels provides a high safety factor in that workers and inspectors are provided with a quicker ability to move between floors rather than using temporary ladders or other hazardous configurations.

A number of particular components enable the modular stair units 102 to be assembled as discussed in FIG. 5 and combined with other modular stair units as discussed in FIG.

Figure 7:
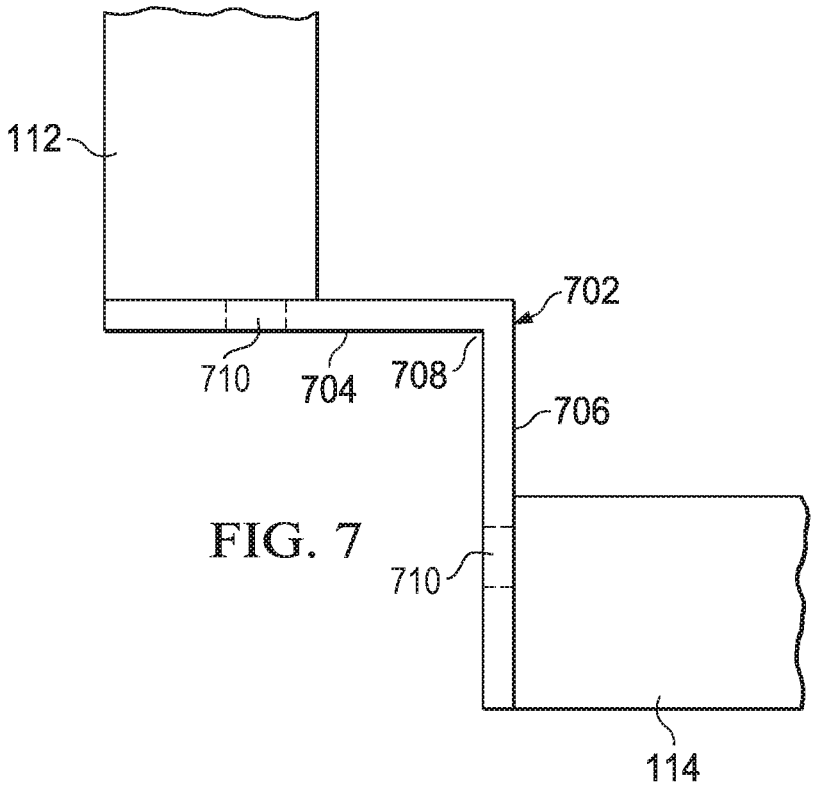
FIG. 7 illustrates a configurable corner bracket.

6 in order to provide a multilevel stair structure. Referring now to FIG. 7, there is illustrated the adjustable manner in which the long sides 112 and short sides 114 of the top landing 104 may be connected with each other at their ends in order to provide a configurable connection for the use of different sized corner columns 108. The long sides 112 and short sides 114 of the top landing 104 are interconnected via an L-shaped corner bracket 702. The corner bracket 702 comprises a first member 704 and a second member that are interconnected along an edge 708 at an orthogonal angle. The corner bracket 702 also defines holes 710 within the members 704 and 706 to enable the corner bracket to be bolted to a corner column 108. The holes 710 aligned with corresponding holes on the corner columns 108 in order to enable the corner columns and corner brackets to be bolted to each other. The corner bracket 702 is connected to the long member 112 and short member 114 via welding, bolting or other connection means. Since the long members 112 and short members 114 of the top landing 104 are interconnected with the corner bracket 702, the corner bracket 202 may be configured in different embodiments to bolt the two landings to different sized corner columns 108. Thus, the corner bracket 702 may have different sizes in order to accommodate different sized corner columns 108. A top landing 104 may be configured for different sized corner columns 108 by merely utilizing the appropriate corner bracket 702. Differing size corner columns 108 and corner brackets 702 would be utilized depending upon the number of modular stair units 102 that were to be stacked for a particular stairwell. A greater number of stacked modular stair units 102 require the use of larger corner columns 108 as the structure is self-supporting and larger beams are needed to support the greater weight of more modular stair units within a stack.

Figure 8:
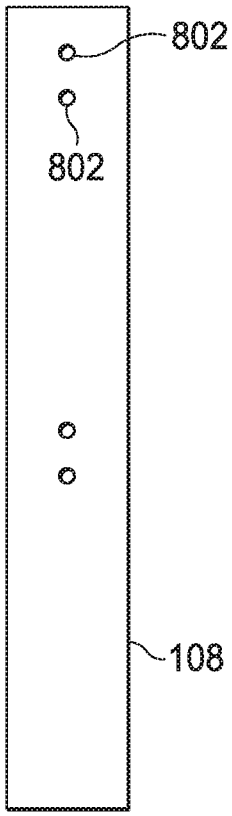
FIG. 8 illustrates a corner support column.

Referring now also to FIG. 8, there is illustrated a corner column 108. As mentioned above, the corner columns can be different sizes depending on the number of levels to be supported in the stair well. The corner column 108 includes holes 802 located at a top end thereof. The holes 802 located at the top end of the corner column 108 enable the modular stair unit 102 stacked on top of the corner columns 108 to be leveled through a connection sleeve as will be more fully described herein below. Multiple holes 802 allow corners of the modular stair unit 102 above the column 108 to be placed at various levels. The corner columns 108 are constructed of a rectangular tubular steel and may be of different sizes depending upon the number of levels to be stacked in a particular stairwell. Thus, larger corner columns 108 may be utilized when a greater number of modular stair units 102 are to be stacked on top of one another.

Figure 9:
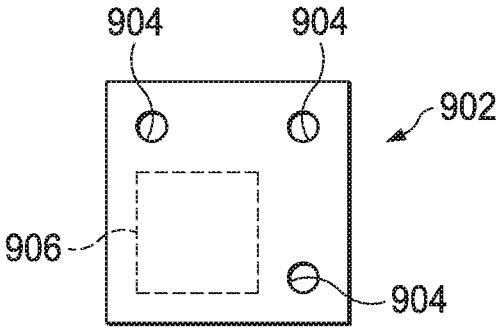
FIG. 9 illustrates a foundation connection plate.

Referring now to FIG. 9, there is illustrated a foundation support plate 902. The foundation support plate 902 would be welded or connected in some other means to a bottom end of a corner column 108 of the lowest level modular stair unit 102 of a stairwell in area 906 indicated generally in FIG. 9. The foundation support plate 902 would be connected to the bottom end of each of the corner columns 108 and enable the base of the stairwell structure to be secured to a foundation. The foundation support plate 902 defines multiple holes 904 therein which may be used for securing the modular stair unit 102 to the foundation using bolts, screws or some other type of foundation connecting means.

Figure 11:
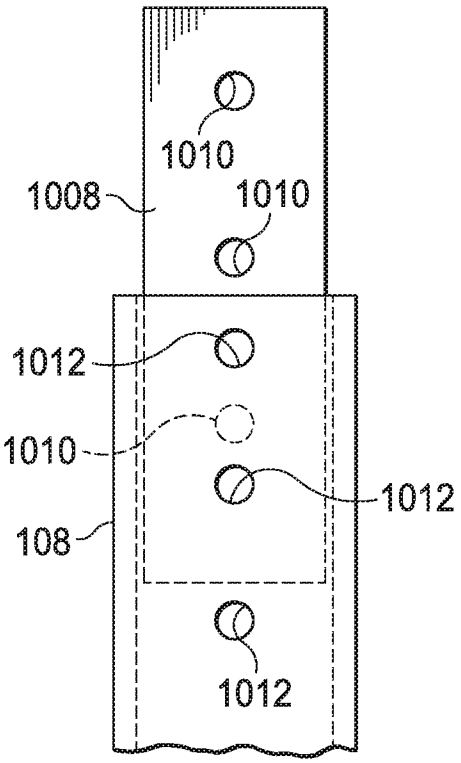
FIG. 11 illustrates a second side view of a connection sleeve and corner column.
Figure 10:
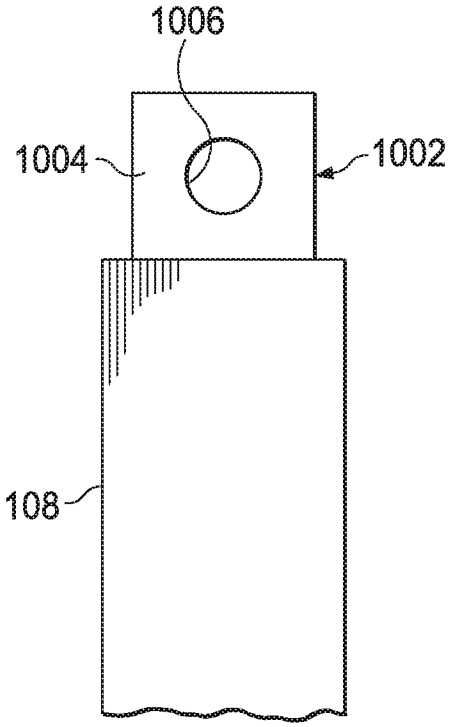
FIG. 10 illustrates a first side view of a connection sleeve and corner column.

Referring now to FIGS. 10 and 11, there is illustrated one side of the connection sleeve 1002. The connection sleeve 1002 is a rectangular tubular member having a size enabling the connection sleeve to be slid within the interior of the corner columns 108. On a first pair of sides 1004, the connection sleeve 102 defines a lifting eye 1006. The lifting eye 1006 enables a hook, strap, cable, etc. to be inserted therein and used for lifting a modular stair unit 102 into which the connection sleeve 1002 has been installed within a corner column 108. The associated modular stair unit 102 may be lifted into the air using the lifting eye 1006 to enable the modular stair unit to be placed upon another modular stair unit within a stairwell. Located on a second pair of sides 1108 of the connection sleeve 1002 are a plurality of leveling holes 1010. The leveling holes 1010 of the connection sleeve 1002 may be aligned with corresponding leveling holes 1012 located on the corner column 1008. The connection sleeve 1002 slides into the interior of the corner column 108 and the leveling holes 1010 are aligned with a desired leveling hole 1012 within the corner column. A bolt may then be placed through the aligned leveling holes 1010 and 1012 to maintain the connection sleeve 1010 at a desired level.

Figure 12:
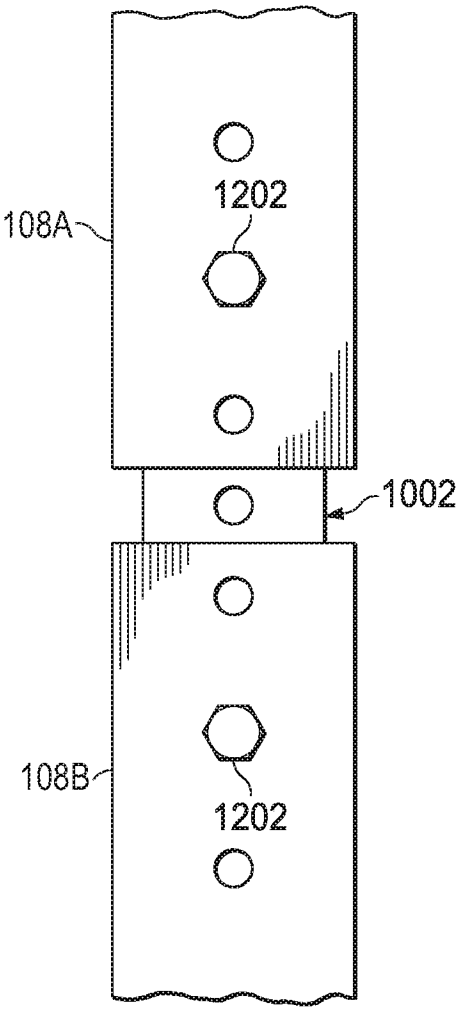
FIG. 12 illustrates a connection sleeve interconnecting first and second corner columns.

Referring now to FIG. 12, there is illustrated a connected pair of corner columns 108 using a connection sleeve 1010. As discussed previously, the connection sleeve 1002 slides within the corner columns 108. The connection sleeve 1010 is maintained at a selected height by placing a bolt 1202 through an aligned pair of leveling holes 1010/1012 within the connecting sleeve 1002 and corner column 108. Once the connection sleeve 1002 is secured within the lower corner column 108A, the upper corner column 108B may be lowered onto the connection sleeve 1010 and once it has been set to a desired height, a bolt 1202 may be used for securing the upper corner column 108 to the connection sleeve 1010 through aligned leveling holes 1010/1012.

Figure 13:
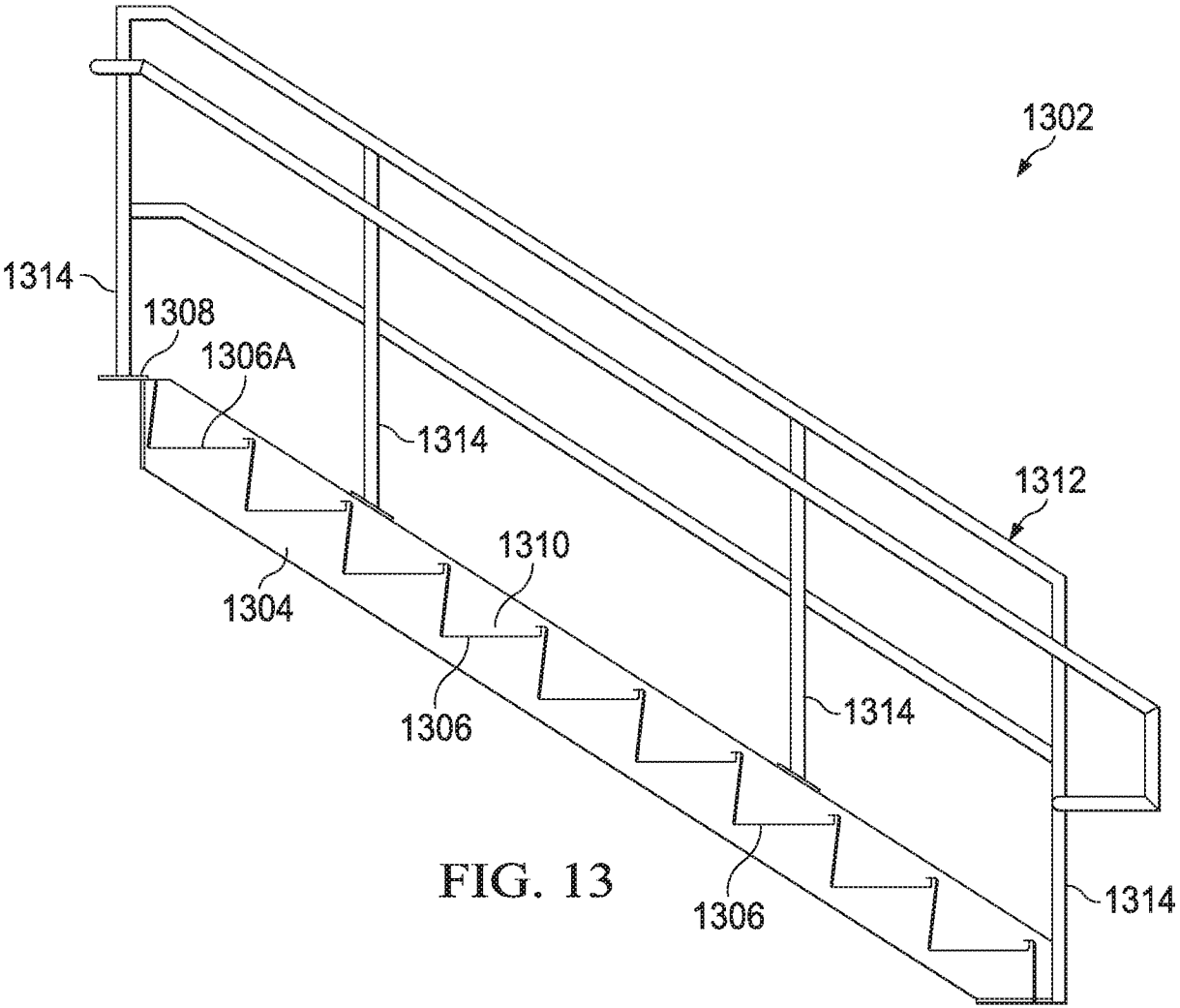
FIG. 13 illustrates a cross-sectional view of a stair runner.

Referring now to FIG. 13, there is illustrated a cross-sectional side view of a stair runner 1302 that interconnects a lower level to the mid-level landing 106 or the mid-level landing to the top landing 104. This may be the upper or lower stair runner as described earlier. The stair runner 1302 consists of a stringer 1304 located on each side of the stair runner to support a number of tread pans 1306. The tread pans 1306 connect to and are supported by the stringers 1304 located on each side thereof and further connect to the tread pans above and below the tread pan along the top and bottom edges. In the case of the top tread pan 1306A, this tread pan connects to the top edge 1308 of the stair runner 1302 and the tread pan immediately following the top tread pan. The tread pan 1306 includes a concrete holding well 1310 into which concrete may be poured after the stairway has been installed to provide a tread walking area for the stairway. However, it should be realized that the tread pan 1306 may be used prior to the pouring of concrete into the holding well 1310 by construction workers and inspectors. Also mounted to each side of the stringers 1304 are railings 1312 that may be of various configurations depending upon local building codes and/or construction requirements. The railings 1312 are bolted at the bottom of vertical support posts 1314 to the stair stringers 1304.

Figure 14:
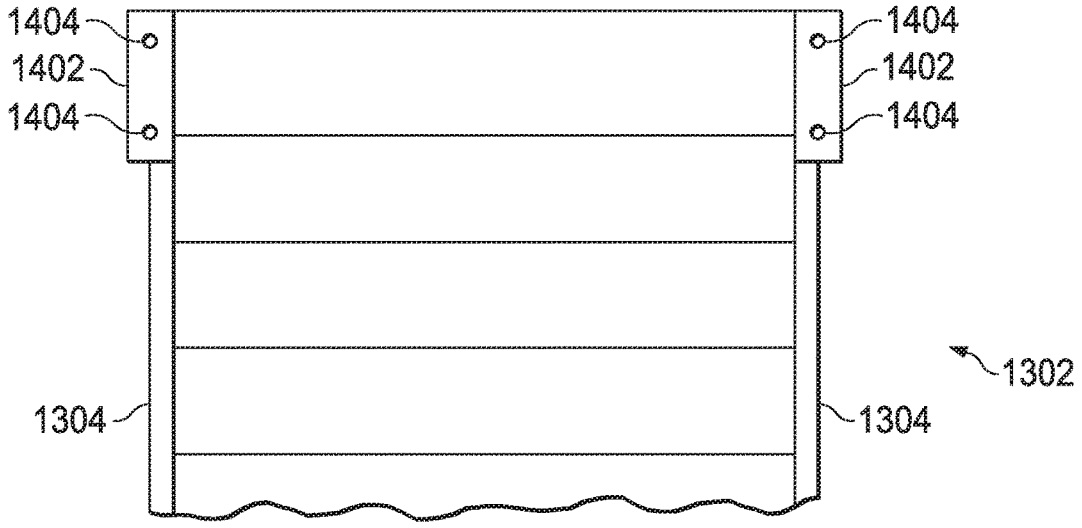
FIG. 14 illustrates connection brackets for a stair runner.

Referring now also to FIG. 14, there is illustrated a back side view of the stair runner 1302. In order to connect stair runner 1302 to either the mid-level landing 106 or top landing 104, a pair of mounting plates 1402 are connected to each of the stringers 1304 of the stair runner 1302. The mounting plates 1402 include a pair of holes 1404 therein for bolting the top edge of the stair runner 1302 to a crossbeam of the mid-level landing 106 or top landing 104. The use of bolts and the mounting plates 1402 enable the stair runner 1302 to be quickly and easily removed from or attached to the modular stair assembly 102 to enable transport to a construction site.

Figure 15:
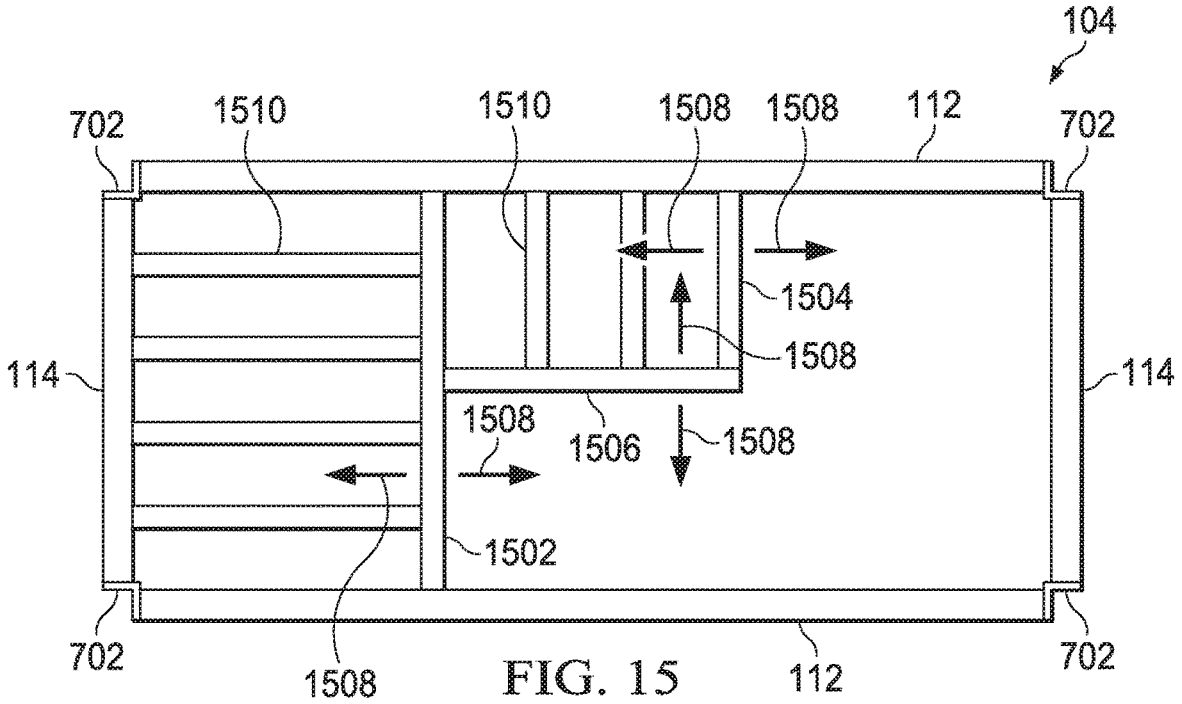
FIG. 15 illustrates a top view of an upper level landing.

Referring now to FIG. 15, there is illustrated a top view of the top level landing 104. The top level landing 104 consists of it the long side members 112 interconnected with the short side members 114 using corner brackets 702. The size of the landing platform upon the top level landing 104 is adjustably configurable by movement of the support beams. Thus, as illustrated in FIG. 15, support beams 1502, 1504 and 1506 are movable in two directions as indicated generally by arrows 1508. In this manner, the platform area can be adjusted to provide more or less area as desired and may also provide for differing size stair runners running from the mid-level landing 106 to the top level landing 104. Alternatively, the platform size may be adjusted to compensate for door opening placement within the associated construction. In this manner, the top level landing 104 may be configured to fit within a number of different configurations of stair runner length and construction door openings to facilitate construction differences. The associated cross-beams 1510 within the landing may be sized to fit within the construction. While the above discussion has been made with respect to the top level landing 104, the mid-level landing 106 may be configured in a similar manner to enable for differences in size of the platform landing, differing door opening placements and differing sizes of stair runners utilized within the construction of a modular stair unit 102.

Figure 16:
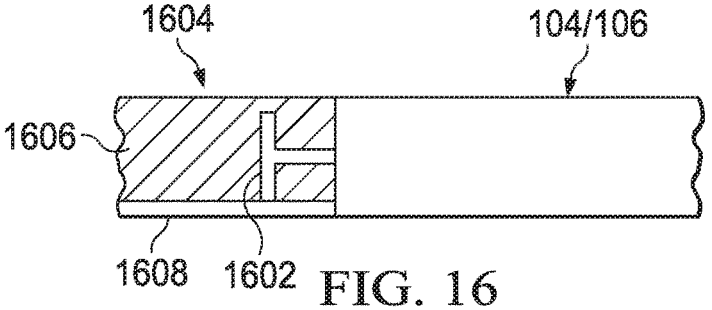
FIG. 16 illustrates the connection of the modular stair unit to a structure using Nelson studs.

One advantage of the modular stair unit 102 configuration is that the units in both the individual and stacked configurations are self-supporting with the corner columns 108 and center columns 110 supporting the stairwell structure without any additional support from surrounding construction. In an alternative configuration, it is also possible for the modular stair units 102 to be supported by the surrounding construction rather than be self-supporting. In the alternative configuration, the modular stair units are placed and stacked upon one another as have been previously described hereinabove. However, as illustrated in FIG. 16, the modular stair units 102 may also include a plurality of Nelson studs 1602 that are welded to or connected in some other manner to the beams forming the sides of each of the top level landing 104 and mid-level landing 106. Each of the long and short beams within the top level landing 104 and mid-level landing 106 include a plurality of Nelson studs 1602 along their length. These Nelson studs 1602 would be extended into a form area 1604 that comprises a concrete form that is a part of the building structure for containing poured concrete around the Nelson studs 1604. After the Nelson studs 1602 are appropriately located within the form area 1604, the form area 1604 is filled with concrete 1606. The previously built sides 1608 of the form area 1604 and the beam of the top level layer 104 or mid-level layer 106 contain the concrete 1606 within the form area and upon hardening of the concrete enables the surrounding structure to support the top landings 104 and mid-level landings 106 without requiring the support of the corner columns 108 and center columns 110. This enables the corner columns 108 and center columns 110 to be unbolted from the top landing 104 and mid-level landing 106 and read moved from the stairwell structure. The stairwell structure remains in place due to the support of the surrounding structures provided through the Nelson studs 1602.

Figure 17:
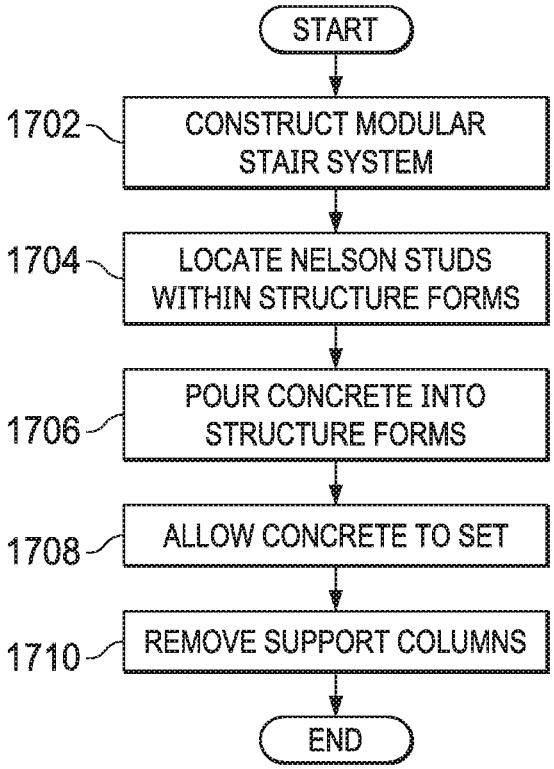
FIG. 17 illustrates a flow diagram describing the process for removing support columns from the self-supporting modular stair unit.

Referring now to FIG. 17, there is illustrated a flow diagram more particularly describing the process for building a stairwell structure that is supported by the surrounding construction rather than being completely self-supporting using support columns of the modular stair unit 102. The process is initiated in a similar manner to that described herein above wherein the modular stair system is constructed by stacking and connecting the modular stair units 102 on top of each other until the desired number of levels is achieved at step 1702. During the stacking process, each of the modular stair units 102 are positioned such that Nelson studs 1602 attached to the modular stair units 102 are appropriately located within the associated form area 1604 at step 1704. Concrete is poured at step 1706 into the associated form areas 1604 and the concrete is allowed at step 1708 to harden. Once the concrete has hardened and the surrounding structure can support the top level landing 104 and mid-level landing 106, the support columns are removed at step 1710 to allow the modular stair units 102 to be completely supported by the surrounding structure.

In this manner, the speed of stair construction at a commercial or residential site can be greatly increased over current construction methods. As mentioned previously, existing construction methods can take several days to completely construct stairwells within a structure that is being built. Utilizing the above described modular stair units 102, a stairwell can be constructed in several hours rather than several days. This provides a great cost savings due to the greatly decreased amount of time required in the construction process. The described system also increases work place safety since stair structures for accessing different floors in a multilevel structure are provided much earlier in the construction process and no longer the require the use of temporary measures such as ladders in order to move between building levels.

It will be appreciated by those skilled in the art having the benefit of this disclosure that this modular stair system provides a manner for more efficiently constructing stairs within a residential or commercial construction. It should be understood that the drawings and detailed description herein are to be regarded in an illustrative rather than a restrictive manner, and are not intended to be limiting to the particular forms and examples disclosed. On the contrary, it's included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A method for building modular stair system, comprising:

assembling a plurality of self-supporting modular stair units, each of the plurality of self-supporting modular stair units associated with a single story of a structure, each of the plurality of self-supporting modular stair units further comprising a self-supporting structure supported by a plurality of corner support columns;

locating a first self-supporting modular stair unit on a foundation of the structure;

securing the first self-supporting modular stair unit to the foundation of the structure;

stacking a second self-supporting modular stair unit on top of the first self-supporting modular stair unit, wherein a top of a first plurality of corner support columns of the first self-supporting modular stair unit engage a base of a second plurality of corner support columns of the second self-supporting modular stair unit;

leveling the second self-supporting modular stair unit using a connection sleeve that slides within the top of the first plurality of corner support columns and the base of the second plurality of corner support columns;

connecting the second self-supporting modular stair unit to the first self-supporting modular stair unit to maintain the leveled second self-supporting modular stair unit using the connection sleeve;

attaching the first and the second self-supporting modular stair units to the structure to enable the structure to support the first and the second self-supporting modular stair units independent of a plurality of self-supporting columns; and removing the plurality of self-supporting columns from the self-supporting modular stair unit after the first and the second self-supporting modular stair units have been attached to the structure to enable the first and the second self-supporting modular stair units to be supported by the structure.

2. The method of claim 1, wherein the step of leveling further includes:

inserting the connection sleeves into the top of the first plurality of corner support columns;

aligning a first set of leveling holes of the connection sleeves with a second set of leveling holes of the first plurality of corner support columns;

maintaining the connection sleeve at a fixed position within the first plurality of corner support columns by a securing mechanism inserted within the aligned first and second set of leveling holes;

inserting the connection sleeves into the base of the second plurality of corner support columns;

aligning the first set of leveling holes of the connection sleeves with a second set of leveling holes of the second plurality of corner support columns; and maintaining the connection sleeves at a fixed position within the second plurality of corner support columns by a securing mechanism inserted within the aligned first and second set of leveling holes.

3. The method of claim 1, wherein the step of stacking further comprises lifting the second self-supporting modular stair unit using at least one lifting hole defined within the connection sleeve inserted into a top of the plurality of corner support columns of the second self-supporting modular stair unit by a lifting mechanism.

4. The method of claim 1, further comprising connecting the first self-supporting modular stair unit to a foundation of the structure using a plurality of foundation plates each connected to a bottom of one of the plurality of corner support columns of the first self-supporting modular stair unit.

5. The method of claim 1, wherein the step of assembling further comprises assembling an upper rectangular landing with a mid-level rectangular landing using the plurality of corner support columns, the plurality of corner support columns comprising a plurality of user selectable corner support columns, wherein the plurality of user selectable corner support columns are based upon a number of self-supporting modular stair units that are to be stacked on top of one another.

6. The method of claim 5, wherein the step of assembling further comprises assembling the upper rectangular landing and the mid-level rectangular landing using a plurality of L-shaped corner brackets.

7. The method of claim 1, wherein the step of attaching further includes:

positioning a plurality of nelson studs located along edges of the first and the second self-supporting modular stair units within a concrete form associated with the structure; and attaching the first and the second self-supporting modular stair units to the structure using the plurality of nelson studs to enable the structure to support the first and the second self-supporting modular stair units independent of the corner support columns.

8. The method of claim 7, wherein the step of removing further comprises removing the plurality of self-supporting columns from the first and the second self-supporting modular stair units after the nelson studs have been attached to the structure to enable the first and the second self-supporting modular stair units to be supported by the nelson studs.

9. The method of claim 1 further comprising adjusting a size of landing areas of the first and the second self-supporting modular stair units to accommodate different lengths of second stair runners and different placements of an entry portal associated with a level of the structure associated with the first and the second self-supporting modular stair units.

10. A method for building modular stair system, comprising:

assembling a plurality of self-supporting modular stair units, each of the plurality of self-supporting modular stair units associated with a single story of a structure, each of the plurality of self-supporting modular stair units further comprising a self-supporting structure supported by a plurality of corner support columns, wherein the step of assembling further comprises assembling an upper rectangular landing with a mid-level rectangular landing using the plurality of corner support columns, the plurality of corner support columns comprising a plurality of user selectable corner support columns, wherein the plurality of user selectable corner support columns are selected based upon a number of the self-supporting modular stair units that are to be stacked on top of one another;

locating a first self-supporting modular stair unit on a foundation of the structure;

securing the first self-supporting modular stair unit to the foundation of the structure;

stacking a self-supporting second modular stair unit on top of the first self-supporting modular stair unit, wherein a top of a first plurality of corner support columns of the first self-supporting modular stair unit engage a base of a second plurality of corner support columns of the second self-supporting modular stair unit;

leveling the second self-supporting modular stair unit using a connection sleeve that slides within the first plurality of corner support columns and the second plurality of corner support columns;

connecting a base of the second self-supporting modular stair unit to a top of the first self-supporting modular stair unit to maintain the leveled second self-supporting modular stair unit using the connection sleeve; and adjusting a size of landing areas of the self-supporting modular stair unit to accommodate different lengths of second stair runners and different placements of an entry portal associated with a level of the structure associated with the self-supporting modular stair unit.

11. The method of claim 10, wherein the step of leveling further includes:

inserting the connection sleeves into the top of the first plurality of corner support columns;

aligning a first set of leveling holes of the connection sleeves with a second set of leveling holes of the first plurality of corner support columns;

maintaining the connection sleeve at a fixed position within the first plurality of corner support columns by a securing mechanism inserted within the aligned first and second set of leveling holes;

inserting the connection sleeves into a bottom of the second plurality of corner support columns;

aligning the first set of leveling holes of the connection sleeves with a second set of leveling holes of the second plurality of corner support columns; and maintaining the connection sleeves at a fixed position within the second plurality of corner support columns by a securing mechanism inserted within the aligned first and second set of leveling holes.

12. The method of claim 10, wherein the step of stacking further comprises lifting the second self-supporting modular stair unit using at least one lifting hole defined within the connection sleeve inserted into a top of the second plurality of corner support columns of the second self-supporting modular stair unit by a lifting mechanism.

13. The method of claim 10, further comprising connecting the first self-supporting modular stair unit to a foundation of the structure using a plurality of foundation plates each connected to a bottom of one of the first plurality of corner support columns of the first self-supporting modular stair unit.

14. The method of claim 10, wherein the step of assembling further comprises assembling the upper rectangular landing and the mid-level rectangular landing using a plurality of L-shaped corner brackets.

15. The method of claim 10 further including:

positioning a plurality of nelson studs located along edges of the first and the second self-supporting modular stair units within a concrete form associated with the structure; and attaching the first and second self-supporting modular stair unit to the structure using the plurality of nelson studs to enable the structure to support the first and second self-supporting modular stair unit independent of a plurality of self-supporting columns.

16. The method of claim 15 further comprising removing the plurality of self-supporting columns from the first and the second self-supporting modular stair units after the nelson studs have been attached to the structure to enable the first and the second self-supporting modular stair units to be supported by the nelson studs.

17. A method for building a self-supporting modular stair system, comprising:

assembling a plurality of self-supporting modular stair units, each of the plurality of self-supporting modular stair units associated with a single story of a structure, each of the plurality of self-supporting modular stair units further comprising a self-supporting structure supported by a plurality of corner columns;

locating a first self-supporting modular stair unit on a foundation of the structure;

securing the first self-supporting modular stair unit to the foundation of the structure;

stacking a second self-supporting modular stair unit on top of the first self-supporting modular stair unit, wherein a first plurality of corner support columns of the first self-supporting modular stair unit engage a second plurality of corner support columns of the second self-supporting modular stair unit;

leveling the second self-supporting modular stair unit using a connection sleeve that slides within the first plurality of corner support columns and the second plurality of corner support columns;

connecting the second self-supporting modular stair unit to the first self-supporting modular stair unit to maintain the leveled second self-supporting modular stair unit using the connection sleeve;

positioning a plurality of nelson studs located along edges of the first and the second self-supporting modular stair units within a concrete form associated with the structure;

attaching the first and the second self-supporting modular stair units to the structure using the plurality of nelson studs to enable the structure to support the first and the second self-supporting modular stair units independent of a plurality of self-supporting columns; and removing the plurality of self-supporting columns from the first and the second self-supporting modular stair units after the nelson studs have been attached to the structure to enable the first and the second self-supporting modular stair units to be supported by the nelson studs.

18. The method of claim 17, wherein the step of leveling further includes:

inserting the connection sleeves into a top of the first plurality of corner support columns;

aligning a first set of leveling holes of the connection sleeves with a second set of leveling holes of the first plurality of corner support columns;

maintaining the connection sleeve at a fixed position within the first plurality of corner support columns by a securing mechanism inserted within the aligned first and second set of leveling holes;

inserting the connection sleeves into a bottom of the second plurality of corner support columns;

aligning the first set of leveling holes of the connection sleeves with a second set of leveling holes of the second plurality of corner support columns; and maintaining the connection sleeves at a fixed position within the second plurality of corner support columns by a securing mechanism inserted within the aligned first and second set of leveling holes.

19. The method of claim 17, wherein the step of assembling further comprises assembling an upper rectangular landing with a mid-level rectangular landing using the plurality of corner support columns, the plurality of corner support columns comprising a plurality of user selectable corner support columns, wherein the plurality of user selectable corner support columns are based upon a number of self-supporting modular stair units that are to be stacked on top of one another.

20. The method of claim 19, wherein the step of assembling further comprises assembling the upper rectangular landing and the mid-level rectangular landing using a plurality of L-shaped corner brackets.

* * * * *